United States Patent [19]

Obosu

[11] Patent Number: 4,691,768

[45] Date of Patent: Sep. 8, 1987

[54] LANCED FIN CONDENSER FOR CENTRAL AIR CONDITIONER

[75] Inventor: Charles B. Obosu, Nashville, Tenn.

[73] Assignee: Heil-Quaker Corporation, Lavergne, Tenn.

[21] Appl. No.: 813,863

[22] Filed: Dec. 27, 1985

[51] Int. Cl.[4] ..... F28D 1/04

[52] U.S. Cl. ..... 165/151; 165/152

[58] Field of Search ..... 165/151, 152, 153

[56] References Cited

U.S. PATENT DOCUMENTS

| | | | |
|---|---|---|---|
| 1,862,219 | 6/1932 | Harrison | 165/152 |
| 2,035,665 | 3/1936 | Palmer | 165/152 |
| 2,079,032 | 5/1937 | Opitz | 257/130 |
| 3,003,749 | 10/1961 | Morse | 257/130 |
| 3,796,258 | 3/1974 | Malhotra et al. | 165/151 |
| 4,034,453 | 7/1977 | Tomita et al. | 29/157.3 |
| 4,038,061 | 7/1977 | Anderson et al. | 62/126 |
| 4,300,629 | 11/1981 | Hatada et al. | 165/151 |
| 4,328,861 | 5/1982 | Cheong et al. | 165/153 X |
| 4,365,667 | 12/1982 | Hatada et al. | 165/152 |
| 4,434,844 | 3/1984 | Sakitani et al. | 165/151 |
| 4,469,167 | 9/1984 | Itoh et al. | 165/151 |
| 4,469,168 | 9/1984 | Itoh et al. | 165/152 |
| 4,480,684 | 11/1984 | Onishi et al. | 165/179 X |

FOREIGN PATENT DOCUMENTS

| | | | |
|---|---|---|---|
| 57-82690 | 5/1982 | Japan | 165/151 |

*Primary Examiner*—Albert W. Davis, Jr.
*Assistant Examiner*—Richard R. Cole
*Attorney, Agent, or Firm*—Jeffers, Hoffman & Niewyk

[57] ABSTRACT

An improved fin configuration is provided for use in central air conditioning unit heat exchangers in which heat transfer takes place between a first fluid, typically a refrigerant, flowing inside a nested plurality of tubes and a second fluid, typically air, flowing between the tubes and through a plurality of heat conducting fins attached to and arrayed between the tubes. Lanced pairs of streamwise adjacent bridge-like formations, one out each side of a generally corrugated fin surface, provide numerous leading edges to generate a plurality of reforming velocity and heat transfer boundary layers which leads to an increase in flow turbulence for enhanced heat transfer between the fins and the second fluid. By strategic location of a pair of such formations between tubes, with the upstream one of the pair at a positive angle of attack to the flow, air flow is directed through the fin to mix with flow on the other side of the fin and hence the heat transfer rate is improved. The provision of a shallow conical annular fin region around each collar attaching a fin to a tube, preferably with a 6° inclination of the conical surface to a plane orthogonal to the collar axis, provides additional enhancement to the heat transfer between the fin and the second fluid.

9 Claims, 9 Drawing Figures

UNI-DIRECTIONAL AIRFLOW

BI-DIRECTIONAL AIRFLOW

LANCED FIN CONDENSER FOR CENTRAL AIR CONDITIONER

TECHNICAL FIELD

This invention relates to improvements in the configuration of the fin element of a finned tube heat exchanger of the type utilized of a condenser in a typical central air conditioning system.

BACKGROUND OF THE INVENTION

At the heart of the typical central air conditioning system is a combination of electro-mechanical elements that work together on a refrigerant fluid, e.g., one of the Freon TM compounds, according to a refrigeration cycle. Typically, the Freon vapor is compressed by an electrically driven compressor and the compressed vapor is cooled by being passed through a heat exchanger, commonly known as a condenser, after which it is throttled and passed through a second heat exchanger where it picks up heat from air within the building. The refrigerant is then returned to the compressor to undergo the cycle once again.

Most conventional heat exchangers generally consist of a nest of tubes made of a thermally highly conductive metal like copper, to which are attached numerous thin metallic fins which conduct away heat from the tubing to transfer it to air flow directed between and over the fins. A motor driven fan typically directs air flow through the fins surrounding the nested tubes. To reduce both the cost of the structure and the power requirements of the fan directing the air flow through the heat exchanger, it is important to maximize the rate at which the refrigerant fluid flowing through the tubes transfers heat to or from the air flowing past the tubes and between the fins, i.e., the "air-side heat transfer."

One solution is to increase the total area of the fins by increasing the number of fins to obtain increased transfer of heat by forced convection to the air flowing therebetween. This, however, soon diminishes the size of the passages between the fins through which the air must flow and would require a more powerful fan to provide the pressure difference to force the desired amount of air flow through the fins. A second alternative is to provide reasonably spaced apart fins having a waffle-like or undulating configuration to increase the area exposed to the air flow. Unfortunately, with this latter solution, a problem arises in the growth of velocity and heat transfer boundary layers which very soon diminish the amount of heat transfer that can take place between the flowing air and the fin surfaces. In recognition of this problem, designers of heat exchangers have focused on techniques to inhibit the growth of velocity and heat transfer boundary layers without significantly increasing the overall pressure difference required to obtain the desired flow of air through the tube and fin assembly.

Heat transfer by conduction must first occur between the surface of the refrigerant carrying tubing and the fins and, thereafter, by convection from the fin surfaces to the air flowing between the fins. There is also a direct transfer of heat from the surface of the tubing by convection to the air flowing past the tubing, but this generally amounts to only a small fraction of the overall heat transfer. It should also be remembered that there are certain limits of material strength and manufacturing limitations which constrain a designer who seeks to shape the fins to maximize the transfer. Examples of patented solutions to the above discussed problems are contained in the following.

U.S. Pat. No. 2,079,032, to Opitz, discloses corrugated edges on the fins to strengthen the fins, as well as fin portions that form substantial angles at the tube collars where the tubes pass through the fins with the focus being on the corrugated fin construction to strengthen the assembled heat exchanger against crushing forces. U.S. Pat. No. 4,480,684, to Onishi et al, teaches the use of offset tube collars in the fins, with the fins themselves lanced in bridge-like formations each of which is parallel to the fin corrugation thereat. U.S. Pat. No. 4,469,168, to Itoh et al, discloses enhanced heat transfer fins that have louvers inclined at a small angle to the direction of flow of the cooling air in a direction opposite to that of the inclination of the fins locally. U.S. Pat. No. 4,469,167, also to Itoh et al, discloses enhanced fins having louvers offset above and below the plane of the fin and inclined at a predetermined angle to the direction of the air flow past the fins. U.S. Pat. No. 4,300,629, to Hatada et al, discloses enhanced fins having peaked bridge-like portions. All of the above mentioned patents, and others of a like nature, offer solutions intended to increase the turbulence in the air flow to inhibit the growth of velocity and heat transfer boundary layers on the fin surface, thereby to ensure a higher efficiency in the heat exchanger.

Because the turbulent air flow through the heat exchanger does not lend itself to satisfactory theoretical analysis, there is need for empirical improvement in heat exchanger fin designs.

DISCLOSURE OF THE INVENTION

Accordingly, it is an object of this invention to provide a fin configuration in a finned tube heat exchanger for improving the heat transfer from the tubes containing one fluid to fins over which a second fluid flows.

It is a further object of this invention to provide a fin configuration in a finned tube heat exchanger for improving the heat transfer by forced convection from the fins to a fluid flowing between, over and through the fins.

It is a related further object of this invention to provide fin configurations which improve heat transfer from the fins to a fluid flowing between, over and through the fins by inhibiting the growth of velocity and thermal boundary layers at the fin surface.

These and other related objects of this invention are achieved by providing in a fin of a finned tube heat exchanger a plurality of cylindrical collars that fit closely around tubes containing a first fluid and, disposed in the generally corrugated fin surface, a plurality of locally parallel pairs of lanced bridge-like formations which provide numerous leading edges to a second fluid passing over the fin surfaces to start numerous short-lived velocity and thermal boundary layers, with selected bridge-like formations inclined to present a positive angle of attack to the local second fluid flow to scoop it over to the other side of the fin. Such bridge-like formations increase flow turbulence and flow mixing, whereby high rates of heat transfer from the first fluid to the second fluid are obtained. Further enhancement of heat transfer rates is provided by shaping the fin surface around each cylindrical collar to be in the form of a shallow conical annular faired into the fin surface.

BRIEF DESCRIPTION OF THE DRAWINGS

The same numbers are used to identify like parts or elements in each of the drawings.

BEST MODE FOR PRACTICING THE INVENTION

Figure 1:
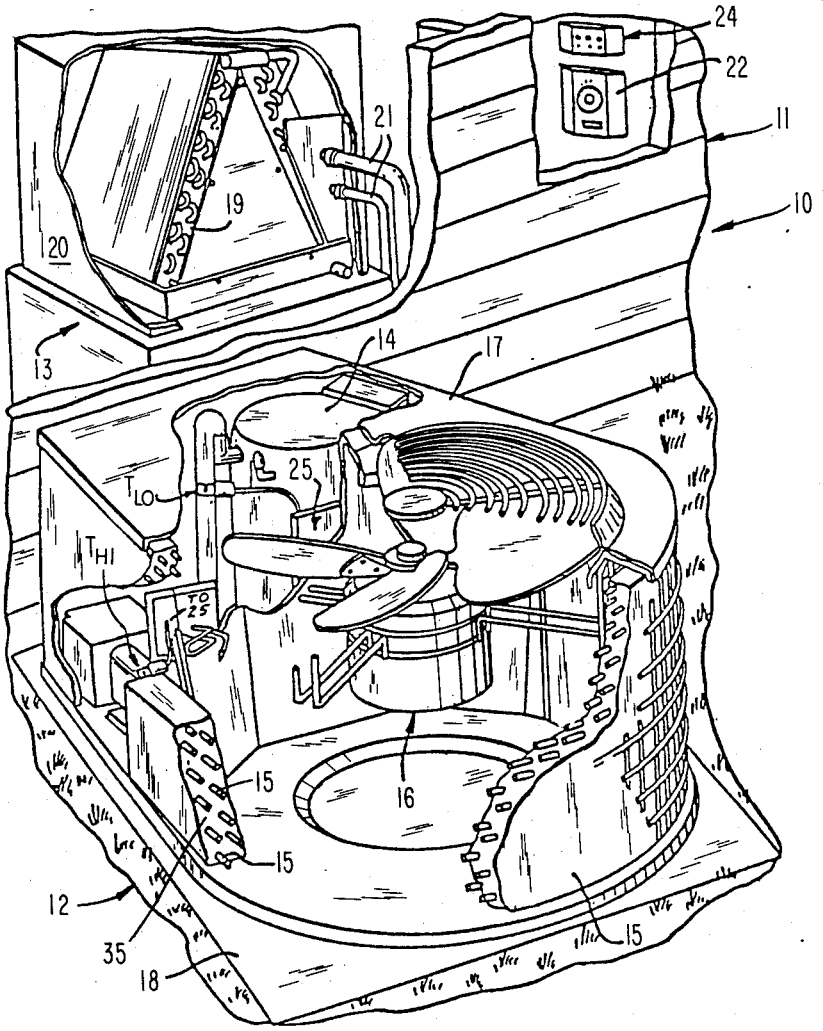
FIG. 1 is a fragmentary perspective view of a typical central air conditioning system which includes a finned tube condenser unit.

In FIG. 1 is shown a typical central air conditioning system 10 that cools a residence 11. The apparatus includes an outdoor portion generally designated 12 and an indoor portion generally designated 13.

The outdoor portion more specifically includes a motor driven compressor 14, a condenser coil 15, and a condenser fan and motor 16. The outdoor portion is conveniently housed in a cabinet 17 designed to protect the apparatus within against the elements. As shown, the apparatus is conventionally installed on a base 18. The air conditioning system further includes an evaporator 19 which is conventionally installed in the residence's forced air furnace system plenum 20 and connected to the outdoor apparatus 12 by suitably shaped and sized conduits 21.

Operation of such an air conditioning system is typically controlled by a user-set thermostat 22 disposed at a suitable sensing location within the residence. The present invention addresses the need to provide fin configurations for improved heat transfer from fluid flowing in the coils of the condenser 15 so as to minimize the cost of constructing and operating such a system.

A typical finned tube heat exchanger is generally assembled by stacking the fins, typically having a corrugated or waffle-type configuration, inserting the tubes through the fins and mechanically expanding the tubes to make physical contact with each fin. Conductive heat transfer then takes place between the exterior of the tube and the collars formed around the openings in the fins.

Figure 2:
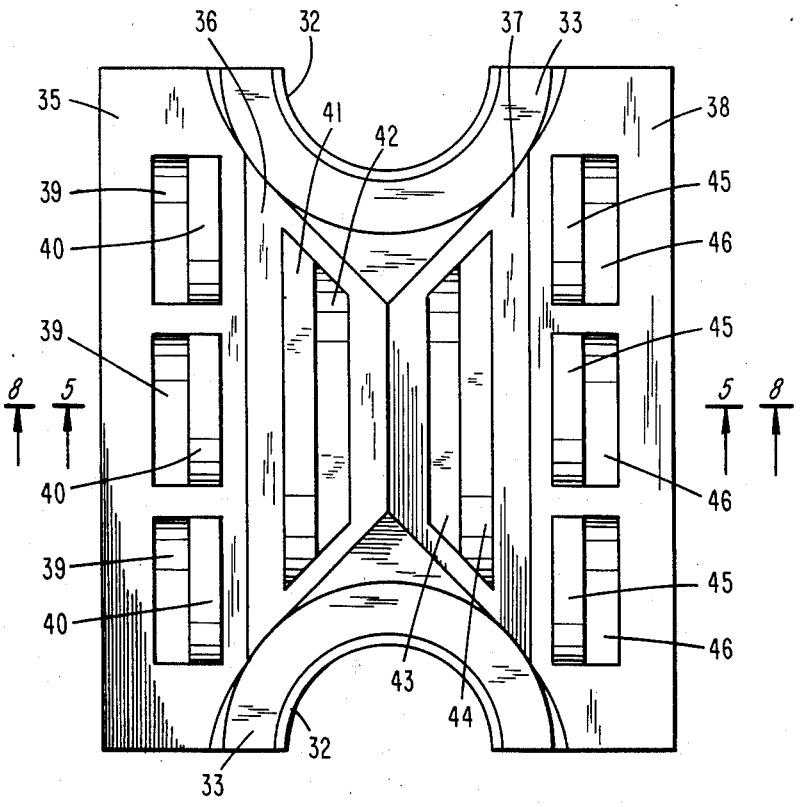
FIG. 2 is a plan view of a fin according to this invention between two adjacent refrigerant carrying tubes.

The symmetrical nesting of the tubes in typical condenser 15 and typical evaporator 19, best seen in FIG. 1, is obtained by locating neighboring tubes inside collars that are symmetrically disposed in the fins that extend between the tubes. Because of the substantial symmetry in the layout of the tubes and the fins within each heat exchanger it is sufficient to examine only that portion of the fin element between adjacent tubes that is repeated again and again in the overally symmetrical pattern. Thus, FIG. 2, for example, presents only that portion of the fin element that extends between the center lines of two adjacent tubes passing through the collars 32 and extending laterally thereof between vertical lines that define the plane separating two adjacent tubes in the lateral direction. In FIG. 2 only the fin element is shown and the tubes that would pass through the collar regions are omitted for simplicity.

Figure 4:
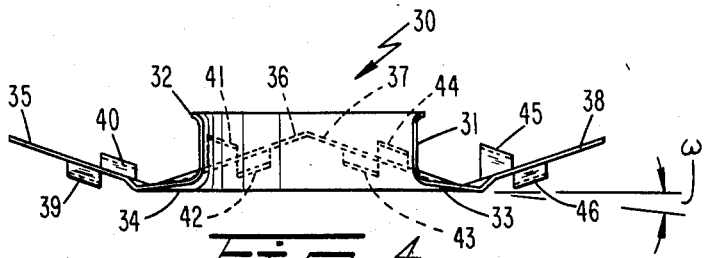
FIG. 4 is a vertical elevation section of one embodiment of this invention particularly suitable for unidirectional air flow.
Figure 5:
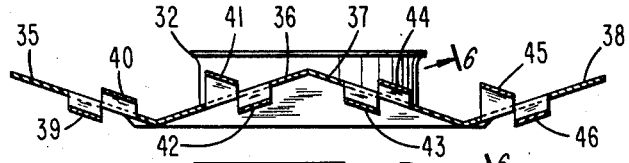
FIG. 5 is an elevation view at section 5—5 (FIG. 2) of the embodiment of FIG. 4.

As is best seen in FIG. 5, which is a section at 5—5 of FIG. 2, the fin element itself has a pleated shape rather like a shallow letter "W" of which the separate surface elements, zones or portions are 35, 36, 37 and 38. Within elements 36 and 37 of the fin structure is formed a collar having a vertical cylindrical portion 31 and a turned upper edge 32 as best seen in FIG. 4. The cylindrical portion 31 is then faired into a shallow conical circular annular zone 33 best seen in FIGS. 2 and 4. This shallow conical annular zone 33 is deliberately formed to be at a shallow angle "$\omega$" with respect to the baseline 34 of collar 31. Experimental evidence that a value of $\omega$ equal to 6° generates substantial heat transfer benefits, although the precise theoretical reasons for this are not well understood because of the complex geometry and air flows that prevail in this region during normal operating conditions.

As is best seen in FIGS. 2 and 5, within the zone 35 of the fin element are formed bridge-like lanced portions 39 and 40, with 39 being formed to be below 35 and 40 being formed to be above zone 35. In the region 36 between the two neighboring collars are also formed lanced bridge-like elements 41 and 42. It is to be noted that elements 39, 40 and 42 are formed to have zones substantially parallel to the respective fin surfaces from which they are lanced. Thus substantial portions of the lanced bridge-like zones 39 and 40 are parallel to surface 35 and, likewise, the bridge-like portion 42 is parallel to the surface 36. However, in this embodiment, the flow is indicated in FIG. 5 as being unidirectional and directed from the left to the right. In this particular embodiment, the bridge-like element 41 differs from elements 39, 40 and 36 in that a substantial portion of bridge-like element 41 is inclined so as to have a positive angle of attack with respect to the arrow indicating the general average air flow direction. In practice, this means that a substantial portion of lanced element 41 is inclined to surface 36 from which it is formed instead of being substantially parallel thereto, so as to scoop oncoming air toward surface 36. Surface 37 is lanced to provide bridge-like elements 43 and 44, respectively below and above surface 37 but both parallel thereto. Finally, surface 38 is formed into bridge-like lanced elements 45 and 46, of which element 45 is comparable to element 41 in that it presents a positive angle to attack to the average air flow direction and is inclined to surface 38, whereas bridge-like element 46 has a substantial portion parallel to surface 38.

Figure 6:
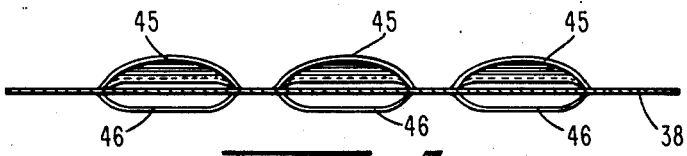
FIG. 6 is an elevation at section 6—6 (FIG. 5) of the embodiment of FIG. 4.

FIG. 6 is a view at section 6—6 of surface element 38 of the fin. As is clear from FIG. 6, the front edge of lanced bridge-like element 45 extends further away from surface 38 than does the comparable leading edge of element 46 also formed from the same surface 38.

With the unidirectional air flow having an average direction normal to the axes of the tubes that would pass through the collars 31 in the fin, with the deliberate formation of bridge-like elements 41 and 45, in surface elements 36 and 38 respectively of the fin element, air flow over the regions 36 and 38 is deliberately caused to change direction, which results in increased mixing and turbulence of the flow. Some of the air flow is also, in effect, scooped from one side of the fin and directed past formations 42 and 46, respectively, to the other side of the fin. This forced mixing of local flows enhances turbulent heat transfer and prevents the growth of thick boundary layers on the fin surface.

The deliberate provision of numerous leading edges by the creation of lanced bridge-like zones 39 through 46 achieves two specific purposes. First, there is the starting of numerous local velocity and turbulent heat transfer boundary layers at each of the leading edges so created. As is well understood by persons skilled in fluid mechanics, a new boundary layer is initiated at each leading edge and grows in thickness downstream thereof. When the boundary layer is thin, the heat transfer rates from the fin surface are at their highest close to the leading edge and immediately downstream thereof. For this reason, it is undesirable to allow the boundary layers to grow in thickness. One way to inhibit the growth of boundary layer thickness, obviously, is to disturb the flow substantially, which is achieved here by the provision of lanced bridge-like formations alternately above and below the principal surface and by forcing mixing and change of direction of the flow by deliberately directing elements 41 and 45 as indicated in FIG. 5. Because there is heat transfer to or from the fin surfaces to the air flowing thereabove, and because the boundary layers are interrupted repeatedly, the flow is substantially turbulent and the degree of turbulence is increased by the provision of numerous leading edges and rapid changes in direction of the air flow. While the theoretical equations to describe this air flow would be insolvably complex, experimental evidence supports the conclusion that the structure depicted in FIGS. 2, 4, 5 and 6 provides enhanced heat transfer from the fin to the fluid flowing over the fins.

Figure 7:
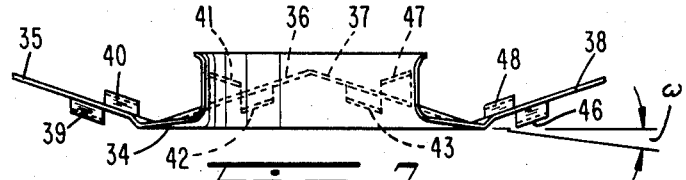
FIG. 7 is a vertical elevation section of a second embodiment of this invention particularly suitable for bidirectional air flow over the fins.
Figure 8:
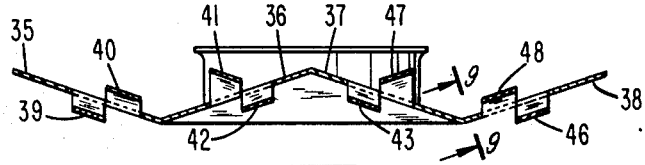
FIG. 8 is an elevation view at section 8—8 (FIG. 2) of the embodiment of FIG. 7.
Figure 9:
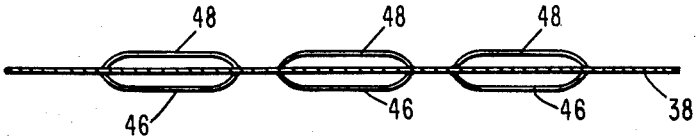
FIG. 9 is an elevation at section 9—9 (FIG. 8) of the embodiment of FIG. 7.

When the overall system is being used to cool the air within a building, it will involve air flow over the fins in only one direction, as indicated by the arrow and the legend "unidirectional air flow", applicable to in FIGS. 5–7. However, for ease of assembly of the fins on tubes when constructing the heat exchanger 15, it is quite desirable to have fins that can provide high heat transfer rates regardless of the airflow orientation of the fin on the tubes. For such a bidirectional air flow fin, a second embodiment as depicted in FIGS. 7, 8 and 9, has a somewhat modified structure as compared to that depicted in FIGS. 4–6.

The embodiment of FIG. 7 differs from that of FIG. 4 in that lanced bridge-like element 47 of FIG. 7 is directed to be symmetrical with element 41, unlike element 44 of FIG. 4. Likewise, element 48 for the bidirectional flow fin of FIG. 7 is parallel to surface 38 unlike element 45 in surface 38 as shown in FIG. 4. In other words, the fin element shown in FIGS. 7 through 9 has complete symmetry to accommodate air flows in both directions. While the embodiment of FIG. 7 may not provide quite the degree of air flow mixing as does the embodiment of FIG. 4, for bidirectional flow users, i.e., as both an air conditioning unit in hot weather and as a heat pump unit in cool weather, the embodiment of FIGS. 7 through 9 provides considerably higher heat transfer rates than that obtained by fin elements known in the prior art.

The enhanced heat transfer rates obtained by the embodiments depicted in FIGS. 4 through 9 are believed to be due to both the annular circular inclined conical region 33 immediately about collar 31 and the selected directions at which elements 39 through 48 are inclined in the respective embodiments. Both features provide for increased turbulence and inhibition of deleterious velocity and boundary layer growths, and each is believed to contribute to the overall enhanced heat transfer rates obtained by the two embodiments discussed above.

Figure 3:
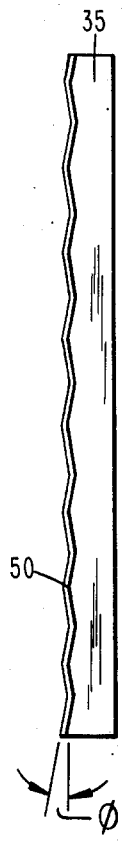
FIG. 3 is a plan view of a fin edge of the invention serrated for improved strength.

Because there are so many apertures created in each fin element and because such fins are constructed of thin metal having a high thermal conductivity, typically aluminum, the fins themselves are relatively fragile. Therefore, for manufacturing convenience and subsequent handling of the fins and the heat exchangers themselves, it is found that the provision of a corrugated fin edge, as best seen in FIG. 3, provides increased structural strength to the fin. The corrugations are symmetric with respect to the edge and a value $\phi = 10°$ is believed to be optimum.

Table 2 presents experimental results that show an improvement in heat transfer rates when the fins are formed according to this invention. Likewise, experimental test data from prototype heat exchangers using fins formed according to this invention show, per Table 1, that the provision of the shallow conical collar base results in increased heat transfer and lower overall air pressure drop across the fins.

In both Tables 1 and 2, Q (BTU/HR) is the airside heat transfer capacity for the test heat exchanger, H(BTU/HR-FT$^2$°F.) is the overall airside heat transfer coefficient for the unit, and $\Delta P$ (IN.$H_2O$) is the airside pressure drop across the heat exchanger. It is apparent from the test data that the provision of lanced bridge-like formations according to this invention increases the heat transfer coefficient and hence the heat transfer capacity of a given size heat exchanger and further that a 6° conical collar base also is beneficial.

It should be apparent from the preceding discussion, with reference being had to the figures provided, that this invention may be practiced with geometries other than those specifically described and disclosed herein. Modifications may therefore be made to the specific embodiments disclosed herein without departing from the scope of this invention, and such are intended to be included within the claims appended below.

TABLE 1

CALORIMETER TEST RESULTS
FLAT VS. CONICAL COLLAR BASES

| COIL TYPE | QUANTITY | AVERAGE INCOMING AIR VELOCITY (FPM) 150 | 250 | 300 | 350 |
|---|---|---|---|---|---|
| COIL HAS | Q | 4800 | 6730 | 7450 | 7960 |
| FINS WITH FLAT | H | 9.2 | 12.2 | 13.2 | 13.9 |
| COLLAR BASE | $\Delta P$ | .037 | .071 | .091 | .111 |
| COIL HAS | Q | 5070 | 6930 | 7660 | 8340 |
| FINS WITH 6° | H | 10.5 | 13.6 | 14.6 | 15.2 |
| CONICAL COLLAR BASE | $\Delta P$ | .017 | .049 | .071 | .095 |

Q = AIRSIDE CAPACITY (BTU/HR)
H = AIRSIDE HEAT TRANSFER COEFFICIENT (BTU/HR-FT$^2$ °F.)
$\Delta P$ = AIRSIDE PRESSURE DROP (IN. $H_2O$)

TABLE 2

CALORIMETER TEST RESULTS COMPARING COIL WITH BASE FIN AND LANCED FIN DESIGNS AT 15 & 18 FPI

| COIL TYPE | QUANTITY | AVERAGE INCOMING AIR VELOCITY (FPM) 150 | 250 | 300 | 350 |
|---|---|---|---|---|---|
| BASE COIL AT 18 FPI | Q | 4800 | 6400 | 7050 | 7580 |
| | H | 8.3 | 10.5 | 11.3 | 11.8 |
| | ΔP | .032 | .060 | .075 | .092 |
| LANCE FIN COIL AT 15 FPI | Q | 4800 | 6550 | 7290 | 7900 |
| | H | 11.2 | 14.7 | 16.1 | 17.2 |
| | ΔP | .025 | .052 | .068 | .085 |
| LANCE FIN COIL AT 18 FPI | Q | 4970 | 7100 | 7880 | 8400 |
| | H | 10.6 | 14.1 | 15.5 | 16.4 |
| | ΔP | .027 | .059 | .082 | .110 |

Q = AIRSIDE CAPACITY (BTU/HR)
H = AIRSIDE HEAT TRANSFER COEFFICIENT (BTU/HR-FT$^2$ °F.)
ΔP = AIRSIDE PRESSURE DROP (IN. $H_2O$)

What is claimed is:

1. In a finned-tube heat exchanger unit, wherein heat transfer takes place between a first fluid flowing through a plurality of spaced-apart finned tubes and a second fluid flowing outside the finned tubes, a fin comprising:

a thin sheet of a heat conductive material formed into first corrugations of predetermined pitch and height and also formed to have apertures therein spaced at intervals and having substantially cylindrical collars around such apertures of a shape and size to closely fit around said heat exchanger tubes for conductive heat exchange therewith, at least one edge of said sheet formed into second corrugations; and said fin being shaped around said collar in the form of a shallow conical annular zone that is peripherally faired into said corrugated shape and is inclined with respect to a plane normal to the axis of said cylindrical collar at an angle of approximately 6°.

2. The fin according to claim 1 including a plurality of ridge-like lanced formations.

3. The fin according to claim 2 wherein at least one of said lanced formations presents a leading edge at a positive angle of attack to the second fluid flowing thereat.

4. The fin according to claim 2 wherein at least one of said of said lanced formations is parallel to the surface from which it is formed.

5. A fin for a finned-tube heat exchanger unit wherein heat transfer takes place between a first fluid which flows through a plurality of spaced-apart tubes, said tubes having a plurality of closely spaced fins secured to the outer surfaces thereof, said fin comprising:

a thin sheet of heat conductive material having a plurality of corrugations formed therein of a predetermined pitch and peak-to-peak height, thereby forming a plurality of surface portions between said peaks; a plurality of apertures for receiving tubes therein formed in said material and spaced apart at regular intervals; a collar formed around each said aperture, said collar having a shape and size to closely fit around said tube for effecting conductive heat exchange between said fin structure and said tube; two of the axially inner said surface portions in each said regular interval each including a first pair of immediately adjacent bridge-like lanced formations extending over substantially the entire said regular interval, each said first pair of lanced formations formed one outwardly of each side of said fin surface, a substantial portion of at least the upstream one of said upstream first pair of lanced formations formed to be inclined with respect to the surface portion from which it is formed so as to present a leading edge at a positive angle of attack to said second fluid flowing thereat, the remaining said ones of said first pair of lanced formations being formed parallel to the surface portions from which they are formed; the axially outer two of said surface portions in each said regular interval each including a plurality of second pairs of immediately adjacent bridge-like lanced formations, said plurality of second pairs of lanced formations extending substantially the entire said regular interval, each said second pari formed one outwardly of each side of said fin surface, a substantial portion of each said lanced formation of each said second pairs being substantially parallel to the surface portion from which it is formed, at least one edge of said fin being corrugated.

6. The fin according to claim 5 wherein a shallow conical annular surface surrounds each said collar, said annular surface being inclined at a predetermined angle with respect to a plane which is normal to the axis of said collar.

7. The fin structure according to claim 6 wherein said angle is approximately 6°.

8. The fin structure according to claim 5 wherein a substantial portion of at least the upstream one of said downstream first pair of lanced formations is formed to be inclined with respect to the surface portion from which it is formed so as to present a leading edge at a negative angle of attack to said second fluid flowing thereat.

9. The fin structure according to claim 5 wherein said corrugated edge has an even zig-zag shape formed of straight portions alternately inclined at approximately 10° with respect to a line passing through the peaks of said zig-zag.

* * * * *

UNITED STATES PATENT AND TRADEMARK OFFICE

CERTIFICATE OF CORRECTION

PATENT NO. : 4,691,768

DATED : September 8, 1987

INVENTOR(S) : Charles B. Obosu

It is certified that error appears in the above-identified patent and that said Letters Patent is hereby corrected as shown below:

Col. 3, line 68, change "overally" to --overall--;
Claim 4, Col. 7, line 46, delete "of said";
Claim 5, Col. 8, line 29, change "pari" to --pair--.

Signed and Sealed this

First Day of March, 1988

*Attest:*

*Attesting Officer*

DONALD J. QUIGG

*Commissioner of Patents and Trademarks*